United States Patent [19]

Bonerb

[11] Patent Number: 4,565,307

[45] Date of Patent: Jan. 21, 1986

[54] METHOD AND APPARATUS FOR CAUSING CAKING MATERIAL TO FLOW IN BINS

[75] Inventor: Timothy C. Bonerb, Orchard Park, N.Y.

[73] Assignee: Vincent C. Bonerb, Boston, N.Y. ; a part interest

[21] Appl. No.: 580,155

[22] Filed: Feb. 14, 1984

[51] Int. Cl.[4] ..... B65D 88/62

[52] U.S. Cl. ..... 222/386.5

[58] Field of Search ..... 222/196, 386.5, 203, 222/94, 95, 105, 1

[56] References Cited

U.S. PATENT DOCUMENTS 2,792,262 5/1957 Hathorn ..... 222/203 X
3,337,094 8/1967 Houston ..... 222/196
3,587,936 6/1971 Riotto ..... 222/196
4,421,250 12/1983 Bonerb et al. ..... 222/386.5 X

*Primary Examiner*—Stanley H. Tollberg
*Attorney, Agent, or Firm*—Bernard, Rothwell & Brown

[57] ABSTRACT

A method and apparatus for assisting discharge flow in bins for flowable materials includes an elongated tubular, bag-shaped, inflatable membrane suspended from near the top of the bin and extending to just above a discharge opening in the bin. The membrane is inflated prior to filling the bin with material which has a tendency to cake or agglomerate. The material will set up around the inflated bag, and when the bag is deflated the material will flow out the opening of the bin, with an assist, if necessary, from a bin liner or the like.

6 Claims, 9 Drawing Figures

METHOD AND APPARATUS FOR CAUSING CAKING MATERIAL TO FLOW IN BINS

BACKGROUND OF THE INVENTION

1. Field of the Invention

This invention relates to improvements in a method and apparatus for assisting in the discharge flow of material which has caking or sticking tendencies so as to set up and not flow freely by gravity in bins for flowable material.

2. Prior Art

When handling certain materials which are ordinarily free-flowing it is well known in the art that such materials sometimes tend to cake, compact, "set up", or otherwise become hard and non-flowable. Such conditions sometimes result in what is known as "ratholing" and "bridging" in silos. In conventional silos such problems result in various measures being taken to cause such materials to flow again. Such measures include placing vibrators on the hoppers of conventional hopper-type bins, simply pounding a hopper-type bin with a sledge hammer, or sending men inside the bin with picks, shovels and other manual implements to break up the caking material. This latter procedure is extremely dangerous. Men have been killed when bridges or rat holes have collapsed and the material in the bin falls. Additionally, bins have been destroyed by implosion when there is a collapse of caking material which bridges within the bin. The degree of caking depends upon the particular material involved.

There is previously known in the art, as shown for example by U.S. Pat. No. 4,421,250 granted Dec. 20, 1983, U.S. patent application Ser. No. 307,089 filed Sept. 30, 1981 and published European International Application No. WO82/03839, and as marketed commercially by All-Flow, Inc. of Buffalo, N.Y., a gravity discharge bin for relatively free-flowing granular material in which the gravity discharge is assisted by pneumatic pressure acting upon a liner to nudge the material into the top of an inverted cone formed at an angle of repose after the material has emptied itself by gravity.

While prior art bins are useful with materials which are completely free-flowing and partially free-flowing, they have a limitation in connection with materials which severely cake, compact or agglomerate, i.e., materials which would ordinarily flow, but when they take up moisture they become so compacted that they will not flow and hence will not discharge by gravity. In such a case any assist by vibration or push on the material in the bin by a liner will not assist the gravity discharge as there is no gravity discharge to start out with and the bin will not empty.

SUMMARY OF THIS INVENTION

This invention provides a method and apparatus for assisting the initial gravity discharge in a gravity discharge material storage bin used for handling caking or agglomerating granular materials. More specifically, the invention contemplates supporting a tubular inflatable bag from the top of the bin generally centrally over the center discharge, creating a void in the material by inflating and filling the flexible bag prior to filling of the bin. The material cakes or "sets up" around the inflated tubular bag. To discharge the material (which is otherwise difficult or impossible to discharge) the bag is deflated leaving a tubular void and the wall liner is caused to collapse inwardly so that the caking material falls into the void left by and provided by the initial inflation of the bag. The bag, of course, is deflated at an appropriate time after the material is in the bin.

DETAILED DESCRIPTION OF THE PREFERRED EMBODIMENT

Figure 1:
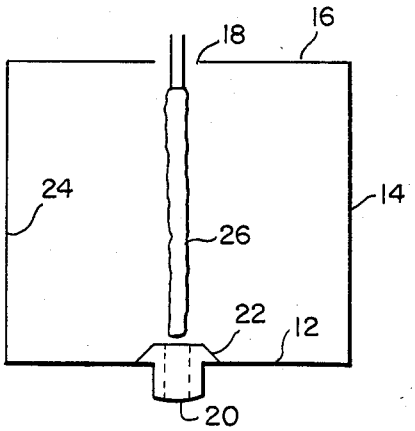
FIGS. 1 through 8 respectively are schematics of a gravity discharge, pneumatically-assisted bin for flowing and flowable granular materials illustrating the method and apparatus of this invention.

Although the preferred embodiment disclosed is in connection with a gravity pneumatically-assisted discharge bin of the type manufactured and sold by All-Flow, Inc. of Buffalo, N.Y., it is useful in any gravity discharge bin including those with vibrating hopper-bottom bins. In FIGS. 1–8 the All-Flow bin is shown in the various stages of fill and discharge. This bin has a bottom or floor 12 with upstanding side walls 14, and a top 16. The top has an opening 18 through which material can be introduced to fill the bin. There is also a discharge opening 20 which has a built-up inclined step 22 above the floor of the bin. The bin is lined with a flexible air-impervious liner 24 which can be expanded to assist gravity discharge as is shown in the U.S. patents and the commercial All-Flow, Inc. system mentioned above.

Hanging centrally within the bin is an inflatable air-impervious elongated, tube-shaped bag 26 connected to a tubular conduit or pipe 28 for supplying air and vacuum. FIG. 1 shows the bin empty and the bag deflated.

As stated previously, this invention is most useful when the granular material is of the type which might cake or compact, e.g., powdered sugar, dextrose, cake mix, limestone and other materials in which it is known that there is difficulty in starting flow because of initial compaction. Particularly difficult-to-discharge materials are high strength cohesive, compactable materials having oily or fatty characteristics such as, for example, cake mix, poultry meal, meat meal, soy meal, cottonseed meal, and corn hulls. Another type of difficult-to-discharge materials are very lightweight fluffy materials such as polyester flakes. Any material which bridges or compacts easily if stored and piled to a depth of four feet or higher in which the angle of repose due to the piling goes from around 45° to 80° are contemplated in connection with the use of the present invention.

Figure 2:
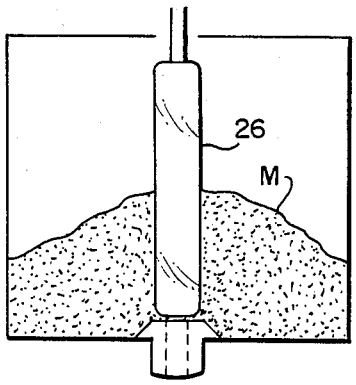
Figure 3:
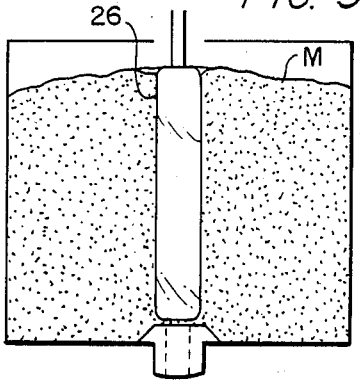
Figure 4:
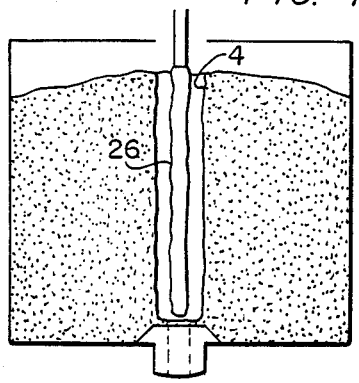

In the present invention the hanging tube-shaped bag 26 is first pressurized with air (or gas) until it reaches its inflated condition as shown in FIG. 2. The bin is then filled with material M to be stored in the bin, the material surrounding and bearing against the walls of the inflated hanging bag 26 until the material fills the bin as shown in FIG. 3. The pressure needed to inflate the tubular bag 26 is only sufficient to overcome the pressure of the material M buried against the side walls of the bag during filling so that the bag 26 does not collapse or significantly decrease in diameter. The inflated tube-shaped bag 26 hangs vertically from above the central discharge opening 20 almost extending to it. The length of the tubular bag 26 will normally be approximately the height of the material in the bin when the bin is full, with the top of the bag near the top of the material in the bin and the lower end of the bag preferably about 6–18" above the discharge opening 20. The bag remains inflated all the time the material M is stored in it, or it can be deflated after the material is loaded as the material will take a set. When the material M has assumed its set or at any time just prior to discharge, the tubular bag 26 is deflated as shown in FIG. 4. This leaves a void or central hole 4 in the material roughly the size of the diameter of the inflated bag. If the material M collapses into this hole H the bin will discharge in the known manner.

Figure 5:
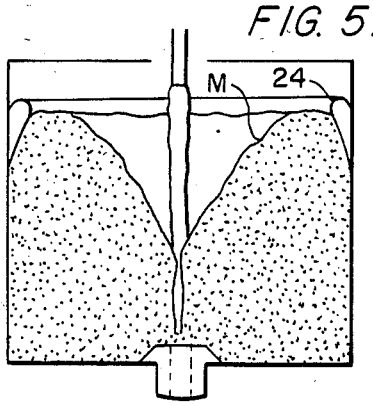
Figure 6:
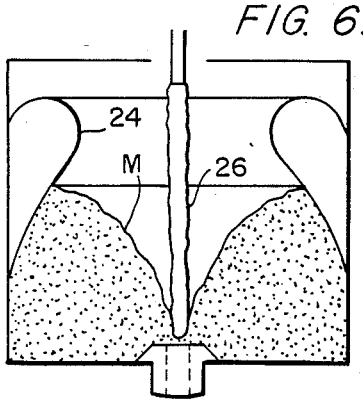
Figure 7:
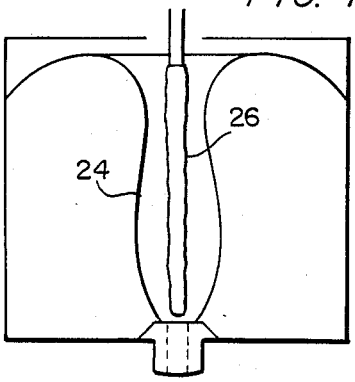
Figure 8:
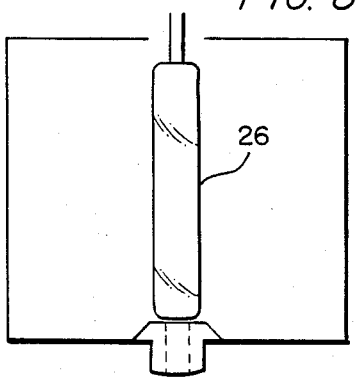

When the material agglomerates or sets up as in FIG. 4 and it is desired to discharge the material, air is introduced behind the flexible, inflatable liner 24, or between two layers of the liner positioned as a flexible, inflated, cup-shaped bag as shown in FIG. 5. The liner is provided with slack in the upper portion of its side to prevent the weight of material from causing forces in the liner which would damage it, as described in application Ser. No. 307,089 filed Sept. 30, 1981, now U.S. Pat. No. 4,449,646 and as incorporated in the All-Flow commercial bins. The initial pneumatic pressure on the liner forces some of the material M into the centrally-created tubular hole 4 causing the caked material to crack and flow through discharge opening 20. The material being continuously moved and cracked by pressure behind the liner 24 continues its flow utilizing the gravity discharge and pneumatic assistance as shown in FIG. 6 until the material is completely emptied (or emptied to a desired level). When completely emptied the discharge liner 24 is inflated as shown in FIG. 7. The discharge liner is then returned to its original position and the tubular bag 26 may be inflated as shown in FIG. 8 to be ready for the next loading of material into the bin.

Figure 9:
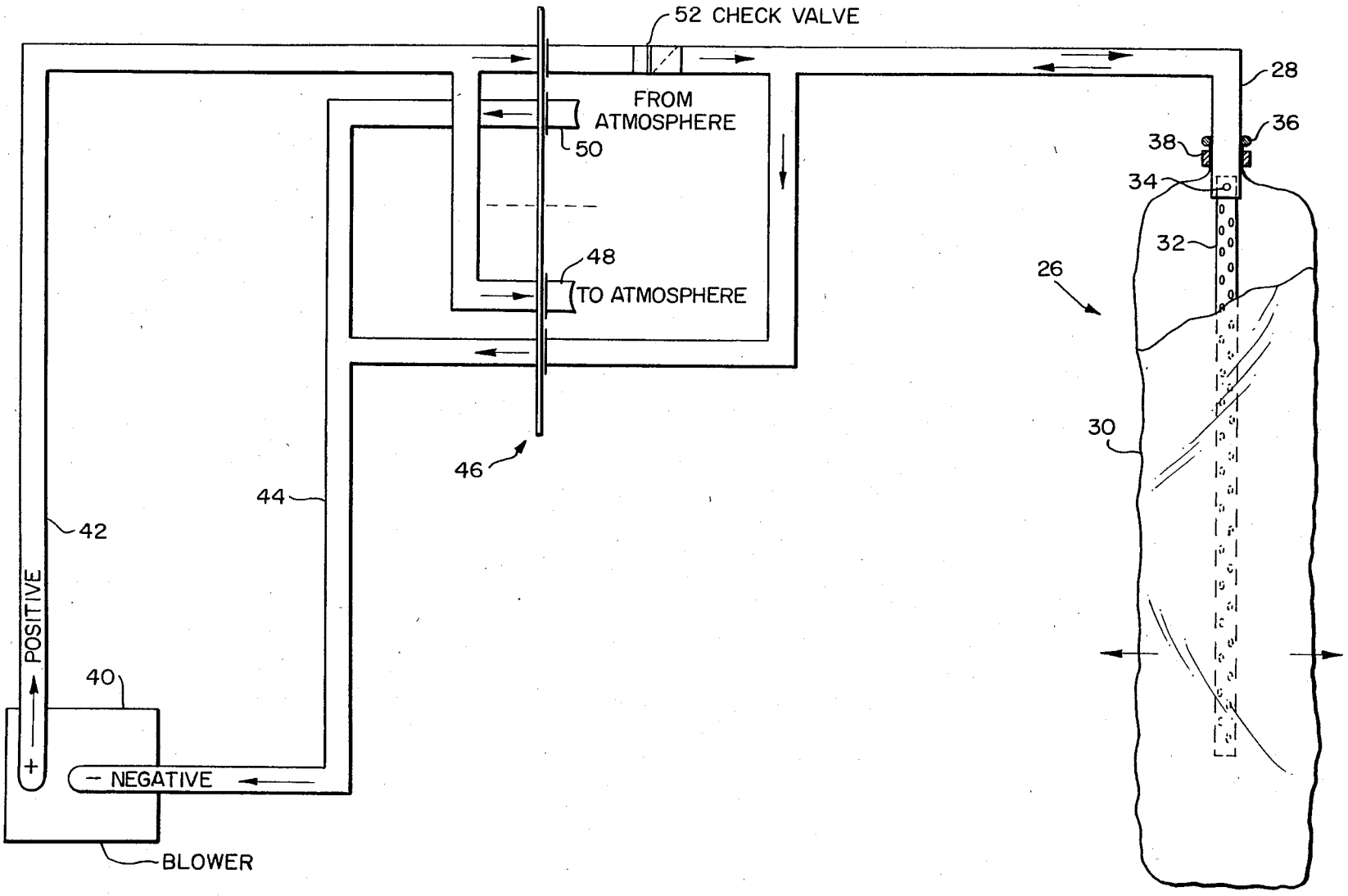
FIG. 9 is a schematic illustrating the details of the hanging membrane and the pneumatic controls therefor.

FIG. 9 shows the details of the flexible, tubular bag 26 which is formed with an elongated bag-shaped flexible wall membrane 30 of non-stretchable, but flexible vinyl and nylon reinforced material generally available on the market. The flexible wall membrane surrounds a perforated tube 32 which is attached to the rigid airway or pipe 28 by a swivel joint 34. The bag may have a roped edge 36 and a clamp fastener 38 holding the bag airtight to the pipe 28.

For applying positive and negative pressure to the inside of the flexible wall membrane there is provided a blower 40 blowing air out line 42 and pulling vacuum through line 44. A valve 46 of the type described in prior application Ser. No. 465,797 filed Feb. 11, 1983 is shown for controlling the air passages as well as alternate passages to and from atmosphere 48 and 50. In the supply line there is a one-way check valve 52.

When it is desired to inflate the flexible wall membrane 30 the blower 40 is turned on, air is blown through passage 42 and through the check valve 52. Air is pulled in from atmosphere through line 50. On switching the valve 46 the intake of the blower 40 is connected to the inside of the bag 26 to draw vacuum through line 44 and deflate the bag quickly while the outlet of the blower passes to atmosphere through line 48.

By way of nonlimiting examples, the present invention has been tested and used in the following specific embodiments:

EXAMPLE 1

A 9-feet diameter All-Flow bulk storage and handling bin 8 feet high having a central discharge and including the All-Flow pneumatically-assisted discharge liner and sensing probe to control actuation of the liner was filled with "baker's fine" sugar having a moisture content which caused it to cake or set up within two to three hours of filling in the bin. The bin was provided with a hollow inflatable, tubular bag about 16–18" in diameter and about 7½ feet in length which hung so that its lower end was about 6 inches above the center discharge opening. The tubular bag was filled with about 10 inches water pressure, enough to overcome the pressure from the sugar and retain its form. After the bin was filled with the sugar, the sugar set and caked. Just prior to discharge the tubular bag was deflated and it left a void or central hole at the place where the bag had been, the hole being the shape of the inflated bag. Vacuum was continuously applied to the tubular bag so as to keep it deflated. The bin liner was actuated under control of a sensing probe which sensed the void in material over the discharge opening and caused inflation of the liner to begin which expanded the liner to collapse the central hole or void in the sugar from the top downwardly. As the sugar fell from the top of the central hole or void it began to break up.

EXAMPLE 2

An All-Flow bulk storage handling system bin with the pneumatically-assisted discharge liner having a diameter of 21 feet and a height of 16 feet with a center discharge was filled with approximately 35,000 pounds of polyester flakes having a bulk density of 7 pounds per cubic foot. As the material was filled into the bin, it was manually compacted by men inside the bin. A tubular bag about 14 feet long was supported with its lower end about 12 inches above the discharge opening and inflated to its normal diameter of about 3 feet with sufficient pressure to cause the bag to hold its shape. The material in the bin compacted and left a central void or hole above the discharge opening when the bag was deflated. Prior to discharge, the tubular bag was deflated, the material below the bottom of the bag just above the discharge flowed into the discharge opening into a conveyor and the liner of the bin was caused to expand inwardly by a manual operation of the controls simulating the probe. The compacted material collapsed into the hole, fell to the discharge opening, and was conveyed away perfectly, much to the surprise of a representative of the company which supplied the polyester flake material. The main reason why the small (6") screw conveyors were so efficient in handling these caked-up materials is that when the materials roll and fall down in the void area, they break up and are also aerated. Also, there is rarely more than 1–2' of material (head pressure) that rests on the conveyor. This was an unexpected benefit. Without the creation of a central void the compacted polyester flakes would most likely not have been easily discharged.

As can be seen, this invention is extremely useful in expanding the range of materials which can be handled with gravity discharge bins thus increasing the range of materials that the bins are capable of handling and also allowing the bin to discharge even when materials may cake or "set up" in it inadvertently.

Although the invention has been described in its preferred embodiment as being applicable to a central discharge bin, i.e., a bin with a side discharge opening in the center of the bottom, the invention could also be useful in a bin having its discharge off center, in which case the tubular membrane would also create a void above the discharge opening. The invention would also be applicable to other bins including other assisted discharge bins, e.g., those with vibrators to assist discharge.

Although the invention has been described in the environment of a stationary bin, it is obvious that the invention is also applicable to bins which are mounted in transportation vehicles such as trucks, rail cars, and shipping containers.

What is claimed is:

1. A material handling and storage bin for handling generally granular material which material has a tendency to cake and become nonfree-flowing, the bin being of the type having a top, side walls and a bottom with a discharge opening therein and a flexible pneumatically-operated, generally cup-shaped liner lining the bottom and side walls of the bin to force material into an angle of repose after it is discharged by gravity, the improvements for handling caking material comprising; an elongated, tubular, bag-shaped inflatable membrane suspended from the top of the bin above the discharge opening and having a length approximately as long as the depth of material to be filled in the bin, and means for selectively supplying pressure or vacuum to such tubular, bag-shaped membrane so that the bag-shaped membrane can be inflated prior to filling the bin, and evacuated after filling the bin and prior to initiating discharge through inflation of the pneumatically-operated liner therein.

2. A bin as defined in claim 1 further comprising means for mounting the upper end of the tubular, bag-shaped member by swivel means.

3. A bin as defined in claim 2 further comprising a four-way slide valve controlling the application of positive and negative pressure to the inside of the tubular member.

4. A bin as defined in claim 1 further comprising a perforated tubular member extending within the bag-shaped, inflatable member for a substantial portion of length thereof, the tubular member being connected to the means for supplying pressure or vacuum to the membrane.

5. A method of causing the flow and discharge of granular material in a system where the material is stored in a bin having a bottom, top and side wall, and the material is allowed to empty by gravity until the material assumes generally an angle of repose, the top portion of the material is nudged into the angle of repose by a pneumatically-actuated liner having slack material in its side wall within the bin, the improvements in causing caking or agglomerating material to flow comprising the following steps; creating a void in caking or agglomerating material in the bin by hanging an inflatable tubular bag in the bin from the top to a point just above a discharge opening, inflating the bag prior to filling the bin, filling the bin with the material so that the inflated tubular bag creates a tubular void in the material in the bin, deflating the bag prior to actuating the pneumatic liner, inflating the pneumatic liner to cause breaking up of the compacting material into the void created by the bag, and allowing the material to discharge by gravity.

6. A material handling and storage bin for handling generally granular material which material has tendency to cake and become non-flowing, the bin having a top, side walls, and a bottom with a discharge opening therein, and means to cause material in the bin to be forced for discharge by gravity, the improvements for handling caking material comprising: an elongated, tubular, bag-shaped, inflatable membrane suspended from the top of the bin above the discharge opening and having a length approximately as long as the depth of material to be filled in the bin, a perforated, tubular member extending within the bag-shaped, inflatable membrane for a substantial portion of the length thereof, swivel means connecting the upper end of the tubular bag-shaped member and perforated tubular member to allow swiveling movement, and means connected to the perforated tubular member for selectively applying pressure or vacuum to the tubular bag-shaped membrane so that the bag-shaped membrane can be inflated prior to filling the bin and deflated after the filling of the bin and prior to initiating discharge by forcing material to be discharged by gravity.

* * * * *